US005391132A

United States Patent [19]

Greenwald

[11] Patent Number: 5,391,132

[45] Date of Patent: Feb. 21, 1995

[54] FREE STANDING ROTATOR CUFF DEVELOPMENT DEVICE

[76] Inventor: Dale R. Greenwald, 1190 Ithaca Dr., Boulder, Colo. 80303

[21] Appl. No.: 78,518

[22] Filed: Jun. 16, 1993

Related U.S. Application Data

[63] Continuation-in-part of Ser. No. 945,537, Sep. 16, 1992.

[51] Int. Cl.[6] ..... A63B 21/02

[52] U.S. Cl. ..... 482/91; 482/118; 482/114; 5/646

[58] Field of Search ..... 482/114, 118, 91, 905, 482/134–137, 148, 44–46, 108, 79–80; 128/26, 878, 25 R, 25 B; 5/623, 646, 647, 905, 909; 73/379.06, 379.01; 33/512, 515, 511, 174 D

[56] References Cited

U.S. PATENT DOCUMENTS

| | | | |
|---|---|---|---|
| 2,119,325 | 5/1938 | Goodhart | 602/16 |
| 2,206,902 | 7/1940 | Kost | 482/79 |
| 2,760,774 | 8/1956 | Perez | 482/79 |
| 3,528,413 | 9/1970 | Aydt | 5/647 |
| 3,769,636 | 11/1973 | Friedman | 623/24 |
| 3,908,643 | 9/1975 | Bliss | 602/39 |
| 4,186,920 | 2/1980 | Fiore et al. | 482/79 |
| 4,259,949 | 4/1981 | Axelsson | 128/125 R |
| 4,733,859 | 3/1988 | Kock et al. | 482/79 |
| 4,772,015 | 9/1988 | Carlson et al. | 482/908 |
| 4,996,977 | 3/1991 | Tiedeken | 482/142 |
| 5,094,226 | 3/1992 | Medcalf et al. | 128/25 R |
| 5,221,242 | 6/1993 | Weber et al. | 482/79 |

FOREIGN PATENT DOCUMENTS 0747473 7/1980 U.S.S.R. ..... 482/44

*Primary Examiner*—Stephen R. Crow
*Assistant Examiner*—Jerome Donnelly
*Attorney, Agent, or Firm*—Donald W. Margolis; Edwin H. Crabtree

[57] ABSTRACT

One embodiment is an upright, height adjustable, vertical stand having a freely rotatable elbow and forearm stabilizer, in the form of a receiving cup mounted on its top. The receiving cup is L-shaped, concave, and contoured to receive the elbow of a user, and includes a portion which is parallel to the axis of the forearm of a user, and a portion of the upper arm of a user to secure the upper and lower arm at a 90° angle to one another, which results in the isolation of the rotator cuff muscles at the shoulder joint at any plane of movement. A pivot arm extends from the cup, and includes a hand receiving device adjacent to its end. The device may include a mechanism which allows internal and external shoulder rotation range of motion to be measured, as well as a device by which internal and external shoulder rotation range of motion can be limited. It can be used either without resistance, or with resistance from an external source. A mechanism which allows for adjustable settings of the plane at which the forearm is held during internal and external shoulder rotation may be provided. Various embodiments allow the pivot arm to be extended horizontally, vertically or at an angle from the vertical. In one embodiment a two station device is provided.

26 Claims, 3 Drawing Sheets

FREE STANDING ROTATOR CUFF DEVELOPMENT DEVICE

RELATED APPLICATIONS

This application is a continuation-in-part of my application for "ROTATOR CUFF DEVELOPMENT DEVICE AND METHOD", by Dale R. Greenwald, filed on Sep. 16, 1992, having Ser. No. 07/945,537.

BACKGROUND OF THE INVENTION (a) Field of the Invention

The subject invention as disclosed herein relates to an exercise device, and more particularly, but not by way of limitation, to a free standing, user manipulated devices for exercising or rehabilitating the rotator cuff muscles, and to the methods of using such a devices.

(b) Background of the Invention

The rotator cuff musculature is made up of the teres minor, infraspinatus, supraspinatus and the subscapularis muscles. In rehabilitation, sports activity, daily activity, repetitive work patterns, and injuries due to trauma, one can experience shoulder injuries specific to, or interrelated to the rotator cuff musculature. Also, through the repetitive throwing of an object, such as a ball, swinging of a racquet, striking of a volleyball, swimming, or any sport or other activity in which the arm is extended from the shoulder joint and rotated or moved, the rotator cuff muscles are susceptible to injury. The reason that this type of injury occurs is that the internal rotator cuff muscles experience the development of a greater level of strength as a result of repetitive overhead movement, especially when accompanied by a powerful follow through, as compared to the lesser strength developed by the external rotator cuff muscles in the same activity, thereby creating an uneven antagonistic muscle balance. As a result, there is a substantial chance for injury to the rotator cuff muscles, and more specifically to the weaker external rotator cuff muscles. This is because the external rotator cuff muscles, which are relatively weaker than the internal rotator cuff muscles, cannot maintain balance nor keep pace with the stronger internal rotator cuff muscles or the powerful pectoralis muscles during overhead and powerful follow through movement, and especially not during repetitive overhead and follow through movement, of the arm. Even in the absence of uneven antagonistic internal and external rotator cuff muscle balance, the rotator cuff muscle group is susceptible to injury when subjected to strain without having been properly warmed up. Another problem related to the rotator cuff musculature may come into existence following an injury to the shoulder, or after shoulder surgery, in which the individual may no longer have an adequate range of movement for either the external or the internal rotation of the shoulder and arm, for example, due to adhesions, or simply due to lack of muscle strength.

Heretofore there have been a variety of different types of exercise apparatus and devices used for rehabilitation due to sport and accident related injuries. In U.S. Pat. Nos. 3,315,959 to Carnielli, 4,592,545 to Sagedahl et al., 4,773,398 to Tatom and 5,039,391 to Johnson various types of exercise and physical therapy apparatus are described.

Carlson et al. U.S. Pat. No. 4,772,015 discloses a multi-purpose arm, shoulder and elbow exercise machine including a base a vertical rack and resistance means which can be adjusted vertically and pivotally using a rack-and-pinion system. The machine of this reference is not specifically designed for exercising rotator cuff muscles, and only briefly mentions the rotator cuff muscles. One embodiment taught by this reference includes an exercise arm which carries sliding or floating hand grip assembly. It discloses the use of an elbow stabilizer, and a non-physical range of motion limiter which sounds a "beep" when the desired range is reached. The elbow stabilizer secures the elbow, but does not hold the lower arm at 90° angle to the upper arm during internal and external rotation of the shoulder muscle, which is of importance, as explained below. The audio range limiter is of limited value in limiting the range of motion, as the user is either sure to have some momentum that carries their motion past the "beep" range limitation, or an inefficient use of the equipment as the user slows down their momentum in anticipation of when the beep will sound. It also provides for various angle planes of movement, including the upper arm at 90° abduction for internal and external shoulder rotation; however, the height in which this can be done is limited by the height of its mounting stand. Another embodiment includes a pair of pivoting caster assemblies, each including a pair of casters and a handle.

Pursley U.S. Pat. No. 4,553,747 discloses a rotator cuff exercise machine in the form of a cable pulley system that uses a weight stack, and which provides an elbow support surface on which the arm of a user can rest substantially horizontally while the user is in a sitting position. However, it does not teach the provision of elbow stabilization at 90° upper arm abduction for internal and external shoulder rotation, and mentions the ability to work internal and external shoulder rotation in the horizontal plane of movement, but which provides no elbow support for this plane of movement.

Pipasik U.S. Pat. No. 4,817,943, discloses an exercise machine for the strengthening and development of shoulder muscles of an exercising person, and which mentions the use of an elbow stabilizer, but does not hold the lower arm at a 90° angle to the upper arm during internal and external rotation of the shoulder, which is of importance, as explained below.

In other prior art, Aristolear, Jr. U.S. Pat. No. 4,957,281 discloses a rotator cuff therapeutic exercise apparatus which includes a stack of weights supported on a frame for movement along a working stroke from a rest position against gravitational force to a displaced position and an actuator mechanism on the frame adapted to be gripped and rotated by a hand of a user to move the weights along the working stroke. It is a big and bulky machine that uses a weight stack for resistance, and provides internal and external shoulder rotation with the upper arm at only one plane of usage, 90° arm abduction. It mentions the use of an elbow stabilizer, but does not hold the lower arm at a 90° angle to the upper arm during internal and external rotation of the shoulder, which is of importance, as explained below.

Miller U.S. Pat. No. 4,988,098 discloses a machine for exercising the rotator cuff of a user which includes a forearm support assembly for supporting a forearm of the user in a plane substantially transverse to the plane of the upright support frame, wherein the transverse plane also passes through the shoulders of the user in such a manner that the user's arm is positioned substantially in the transverse plane to isolate the user's rotator cuff. It requires a weight stack as the source of its resistance, which is very dangerous due to the potential for backlash and follow through, especially when dealing with muscles as vulnerable to injury as the rotator cuff muscle. Furthermore, it allows movement, to be performed in only internal and external shoulder rotation with the upper arm at one plane of 90° arm abduction. It also mentions the use of forearm stabilizers, yet it provides no means for stabilizing the elbow in a manner which maintains the lower arm at a 90° angle to the upper arm, nor does it provide a way to adjust the forearm pads to secure the lower arm.

Collins U.S. Pat. No. 4,944,508 discloses a mounting plate which may be adjusted from about 0° to about 90° for various planes of movement, and including a forearm support, but does not provide an elbow stabilizer. Furthermore, the mounting plate must be mounted to some structure, such as a table. This presents a problem of height adjustment for proper use. Furthermore, it neither teaches nor suggests the need to maintain a 90° angle of the lower arm to the upper arm during the exercise of the rotator cuff muscles, nor does it teach a forearm stabilizer which is adjustable, or which allows the use of different size elbow stabilizers to accommodate users having different size elbows in order to lock and secure the upper and lower arms at a 90° angle throughout the movement, in order to ensure proper isolation of the rotator cuff muscles. It provides for various planes of movement, including the upper arm at 90° abduction for internal and external shoulder rotation, although it does not teach nor suggest the use of its system for internal and external shoulder rotation, nor for exercising or rehabilitating rotator cuff muscles.

Also found in the prior art was Anderson, et al. U.S. Pat. No. 5,058,574.

None of the known prior art patents neither specifically describe, teach, nor suggest an exercise method or device which is useful for the development of rotator cuff musculature by isolating the rotator cuff muscles during internal and external rotation against external resistance while fixing the upper heads of the ulna and radius bones of the lower arm of a user at the point where they join to form the elbow, while also fixing the associated scapula against movement, and then moving the lower arm internally and externally at a 90° angle to the upper arm, to thereby cause the intermediate humerus bone, and especially the upper head of the humerus bone within the glenoid cavity, to be substantially isolated for movement during internal and external rotation of the lower arm against resistance. Additionally, there is no mention in the known prior art of the use of a forearm stabilizer which holds and secures the lower arm in 90° abduction to the upper arm during internal and external rotation of the shoulder. Neither has the art taught or suggested such a forearm support in which the width of the support may be adjusted in order to stabilize and secure various size forearms. None of the known prior art teaches or suggests the inclusion of an elbow isolation element which is used solely as a means for isolating the rotator cuff muscles during exercise, by way of a combined elbow and arm support that locks and positions the lower arm at a 90° angle to the upper arm. None of the known or cited prior art either teaches or suggests the use of a rotator cuff muscle development system which supports the elbow, and in which, rather than having a resistance device built into the machine, either no resistance is used, or outside sources of resistance are used. None of the prior art teaches or discloses a system which can be used with an elbow isolating device, and which can also be used for measuring and monitoring range-of-motion and limiting range-of-motion. None of the known or cited prior art either teaches or suggests the use of a physical stop by which either internal and/or external shoulder rotation range of motion can be limited. None of the known prior art teaches or suggests such an exercise method or device which, during its operation, minimizes compensatory movement patterns and the use of larger muscle groups, so that both the internal and external rotator cuff muscles can be better isolated and are strengthened equally to provide balance and antagonistic muscle harmony between the internal and external rotator cuff muscle groups for the purposes of providing true rotator cuff exercise, and to help prevent rotator cuff injuries, and for assisting in the provision of proper rehabilitation of rotator cuff injuries. None of the known prior art references appear to recognize nor to address the dangers of shoulder impingement which may occur when internal shoulder rotation range of movement is done in an excessive range while the upper arm is in 90° abduction from the side of the body. All of the known and cited references teach the use of a hand grip which must be actively held by the hand of the user in order to move the exercise device, whereby the use of a grip requires the active involvement of the fingers, forearm and hand muscles, and movement and action at the wrist joint which results in excess and compensatory movement of these muscles, all of which interferes with and decreases the isolation of the rotator cuff muscles. None of the prior references teaches or suggests the use of a hand or arm receiver which does not have to be gripped. None of the known or cited prior art either teaches or suggests the use of a range of motion indicator, nor do they even recognize suggest the need for one. None of the prior art rotator cuff muscle exercise systems provides a capability for two users to use and work their rotator cuff muscles at the same time while on the same machine.

SUMMARY OF THE INVENTION

It is therefore an object of the present invention to teach an exercise device which is useful for the development of rotator cuff musculature in an efficient, easy and effective way by isolating the rotator cuff muscles during internal and external shoulder rotation with and without external resistance.

It is therefore an object of the present invention to describe and teach an exercise method and device which is useful for the development of rotator cuff musculature by isolating the rotator cuff muscles during internal and external shoulder rotation against external resistance while fixing the upper heads of the ulna and radius bones of the lower arm of a user at the point where they join to form the elbow, while also fixing the associated scapula against movement, and then moving the lower arm internally and externally at a 90° angle to the upper arm, to thereby cause the intermediate humerus bone, and especially the upper head of the humerus bone within the glenoid cavity, to be substantially isolated for movement during internal and external rotation of the lower arm against resistance.

It is another object of the present invention to teach such a device which includes an anatomically formed elbow cup and forearm stabilizer which holds and secures the lower arm in 90° angle to the upper arm during internal and external rotation of the rotator cuff muscles.

Another object of the present invention is to teach the operation of such a device which can be placed adjacent the body of the user, and adjusted, after which the user positions his or her elbow firmly in an anatomically formed elbow securing cup secured by the use of a strap on the elbow cup with the lower arm positioned at 90° from the upper arm, and then rotating a pivot arm inwardly against the resistance of a pivotal resistance assembly, thereby exercising the internal rotator cuff muscles, and then, when this movement is completed, rotating the pivot arm outwardly against the resistance assembly, thereby exercising the external rotator cuff muscles.

It is still yet another object of the present invention to teach such a method of internal and external rotator cuff muscle development against which may be carried out with the upper arm adjacent to the body and substantially vertical, or with the upper arm extending outwardly from the body and substantially horizontal, or in one or more predetermined paths, or angles of the upper arm from the body, so that the use or rehabilitation of the rotator cuff muscles for different activities can be enhanced.

It is a further object of the present invention to teach a device for accomplishing these methods, in which an upright stand which includes a portion which is adjacent to the elbows of the user and carries a pivotal device which provides resistance to both clockwise and counterclockwise rotation and can be adjustably set.

It is another object of the present invention to teach such a forearm support in which the width of the support may be adjusted in order to stabilize and secure various size forearms during internal and external rotation of the rotator cuff muscles.

It is yet another object of the present invention to teach such an elbow isolation element which is used solely as a means for isolating the rotator cuff muscles during internal and external rotation of the rotator cuff muscles, by way of a combined elbow and arm support that locks and positions the lower arm at a 90° angle to the upper arm.

It is another object of the present invention to teach a rotator cuff muscle development system which provides elbow and forearm stabilization which serves to lock and position the lower arm at a 90° angle to the upper arm, and in which, rather than having a resistance device built into the machine, either uses no resistance, or uses outside sources of resistance.

It is another object of the present invention to teach such a rotator cuff muscle exercise system which can be used with an elbow isolating device.

It is further object of the present invention to teach an exercise device which includes an elbow and forearm isolating device which also provides a scale which measures the true range of movement of the internal and external rotation of the shoulder and of the isolated rotator cuff muscles of a user during internal and external rotation, and which also provides a range limiting device.

It is another object of the present invention to teach such rotator cuff muscle exercise equipment which uses a physical stop by which either internal and/or external shoulder rotation range of motion can be limited.

It is still yet another object of the present invention to teach an exercise device which, during its operation, minimizes compensatory movement patterns and the use of larger muscle groups, so that both the internal and external rotator cuff muscles can be properly isolated for the purposes of providing true rotator cuff exercise, and to help prevent rotator cuff muscle injuries, and for assisting in the provision of proper rehabilitation of rotator cuff injuries.

It is another object of the present invention to recognize and to provide a rotator cuff exercise device which avoids the dangers of shoulder impingement which may occur when internal shoulder rotation range of movement is done in an excessive range while the upper arm is in 90° abduction from the side of the body.

It is another object of the present invention to teach such rotator cuff muscle exercise equipment which includes a range of motion indicator.

It is another object of the present invention to teach a rotator cuff muscle exercise device which, does not require the use of a hand grip which must be actively held by the hand of the user in order to move the exercise device, thereby avoiding the active involvement of the fingers, forearm and hand muscles, and also avoiding the movement and action at the wrist joint which results in excess and compensatory movement of these muscles, thereby providing increased isolation of the rotator cuff muscles.

It is another object of the present invention to teach a hand or arm receiver for use with rotator cuff muscle exercise equipment which does not have to be gripped.

It is another object of the present invention to teach such rotator cuff muscle exercise systems which provide the capacity to allow two users to exercise use and work their rotator cuff muscles at the same time on the same machine.

It is yet a further object of the present invention to teach such a device which has an element, such as a rotatable anatomically formed elbow cup mounted at each adjustable resistance pivotal device, for securing the elbow and forearm of a user during the use of the device and a pivot arm having a first end connected to each resistance device and extending outward along the lower arm of a user, with an adjustable handgrip or hand rest located on each pivot arm.

A first preferred embodiment of the present invention includes an upright vertical stand having a freely rotatable elbow and forearm stabilizer, in the form of a receiving cup mounted on the top thereon. The stand for the elbow receiving cup is height adjustable so that the device may be used with precision by a standing user of any height, or while a user is seated or in a supine position. The elbow receiving cup is L-shaped, anatomically contoured to receive the elbow of a user in a snug fit, is tapered and padded, and has an open semi-cylindrical extension which is designed to be parallel to the axis of the forearm of a user, and to receive at least a portion of the lower arm of a user. Associated with the open semi-cylindrical extension is a lower arm securing mechanism, such as a strap, for use in further securing the elbow and lower arm within the elbow receiving cup. The elbow receiving cup supports the lower half of the upper arm, and locks and secures the upper and lower arm at a 90° angle to one another. It has an adjustable strapping on the elbow receiving cup that is used to pull the two sides of the elbow receiving cup closer together, thereby securing the forearm in place, and thereby eliminating any excess or compensatory movement patterns. The elbow receiving cup is adjustable. The exercise device is designed to receive different size elbow receiving cups to accommodate users having different size elbows and forearms, thereby assuring that upper and lower arms are locked and secured at a 90° angle throughout their rotation, in order to ensure proper isolation of the rotator cuff muscles. The use of such an elbow receiving cup results in the complete isolation of the rotator cuff muscles at the shoulder joint. When a user places their elbow in the elbow receiving cup, and secures the lower arm, it locks and positions the lower arm at a 90° angle to the upper arm, thereby isolating the rotator cuff muscles during internal and external rotation of the rotator cuff muscles. By keeping the forearm fixed at a 90° angle to the upper arm, due to the laws of physics, substantially all turning or rotating forces of the forearm, does not allow excess or compensatory movement of the large muscle groups, and the humerus bone is limited to and caused by the isolated rotator cuff muscles. As a result, the rotator cuff muscles are substantially totally properly isolated during internal and external shoulder rotation at any plane of movement.

In each preferred embodiment of the present invention the device includes a mechanism which allows either or both internal and external shoulder rotation range of motion to be measured, as well as a device by which either or both internal and external shoulder rotation range of motion can be limited by the use of physical stops.

This embodiment can be used to control both internal and external shoulder rotation either without resistance, or with resistance from an external source, such as free weights, springs, elastic or rubber tubing, springs, cable pulley systems, a trainer/buddy, or any other outside form of resistance, or from a self contained source of resistance, such as an included resistance clutch. A mechanism which allows for adjustable settings of the plane at which the forearm is held during internal and external shoulder rotation is also provided.

Where a self contained source of resistance, such as an included resistance clutch is used, the preferred embodiment is an adjustable, pivotal resistance clutch assembly. Such an adjustable, pivotal resistance clutch assembly, includes a resistance adjustment hand nut for increasing or decreasing the pivot resistance of each clutch, and thereby of the associated pivot arm. The pivot arm is positioned to be adjacent to, and have a second end which extends to at least about the length of the lower arm and hand portions of a user.

A handgrip or hand receiving device is located adjacent to the second end of each pivot arm. In preferred embodiments, the handgrip or hand receiving device is adjustable along the length of the pivot arm in order to accommodate the different lengths of the lower arms of different users. As detailed below, by using a hand or forearm receiving device, instead of a hand grip. A forearm receiving device is designed to be secured by an open or a relaxed hand and fingers, or by a forearm, or perhaps by a prosthetic hand or forearm of an amputee. Where a hand or forearm receiving device, rather than a hand grip, is used to move the exercise device, it eliminates the need for grasping a hand grip, in order to be used, thereby eliminating the use of forearm and hand muscles. No active involvement of the fingers, forearm and hand muscles, is required, and movement and action at the wrist joint which results in excess and compensatory movement of these muscles, are avoided, thereby increasing the isolation of the rotator cuff muscles, and avoiding the problems which are caused by the use of a hand grip. This creates an increase in the isolation of the rotator cuff muscles, by eliminating muscle action at the wrist joint, and allowing direct muscle action at the shoulder joint. This also eliminates compensatory muscle movement of the arm muscles, thus providing increased isolation of the rotator cuff muscles, and also allowing a more accurate measurement of internal and external shoulder rotation.

By using a pivot arm having a first end connected to the clutch assembly, the pivot arm may be extended horizontally, vertically or at an angle from the vertical outward from the clutch assembly. In one embodiment, the pivot is extended vertically and the vertically adjustable stand is sufficiently tall that a user may use it in a standing position, with the upper arm in 90° shoulder abduction from the side of the body. In that embodiment, the use of a safety stop adjustment allows the degree of internal rotation that can be reached in the vertical to be adjusted and limited, thereby extending the range of external rotation while in the same plane of movement. The use the safety stop adjustment also allows the user to limit the range of internal rotation at 90° shoulder abduction, and thereby avoid the occurrence of harmful shoulder impingement.

The present invention also teaches a two station device on a common base which allows two users to work their rotator cuff muscles at the same time, on the same machine.

In the operation of the exercise devices of the present invention, the user places their body adjacent to the exercise device. The user then positions his or her elbow firmly in the freely rotatable padded and tapered elbow receiving cup, and uses the strapping to firmly secure their elbow and forearm in place, so that the lower arm of the user is positioned at approximately 90° from the upper arm. Where a built in resistance device, such as a clutch, is used, the lateral position of the handgrip or hand receiving device is adjusted along the length of the pivot arm in order to receive the hand or arm of the user. If desired, the plane at which the forearm is held during internal and external shoulder rotation is also adjusted. After these adjustments are completed, each handgrip or hand receiving device is secured, and the user rotates the their hand inwardly. This inward rotation may be either without resistance, or with resistance, but in either instance exercises the internal rotator cuff muscles. When this movement is completed, the user may then rotate their arm outwardly, either without resistance or against resistance, thereby exercising the external rotator cuff muscles.

It is therefore seen that the system of the present invention isolates the elbow and holds the forearm at 90° to the upper arm. It provides a mechanism for limiting the motion of the forearm. It provides a mechanism for measuring the motion and rotation movement of the forearm. It can be used without resistance, or with resistance, as detailed below. It avoids the dangers of shoulder impingement which can occur when internal shoulder rotation range of movement is done in excessive ranges, while the upper arm is in 90° abduction, by having a safety stop adjustment when the assembly is positioned vertically. The user can adjust the assembly unit for from about 0° through about 45°, and to the right or left, thereby controlling the amount of internal shoulder rotation that can be accomplished, and avoiding the chance of harmful shoulder impingement from occurring, while at the same time increasing the range of needed and desired external shoulder rotation.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF PREFERRED

Figure 1:
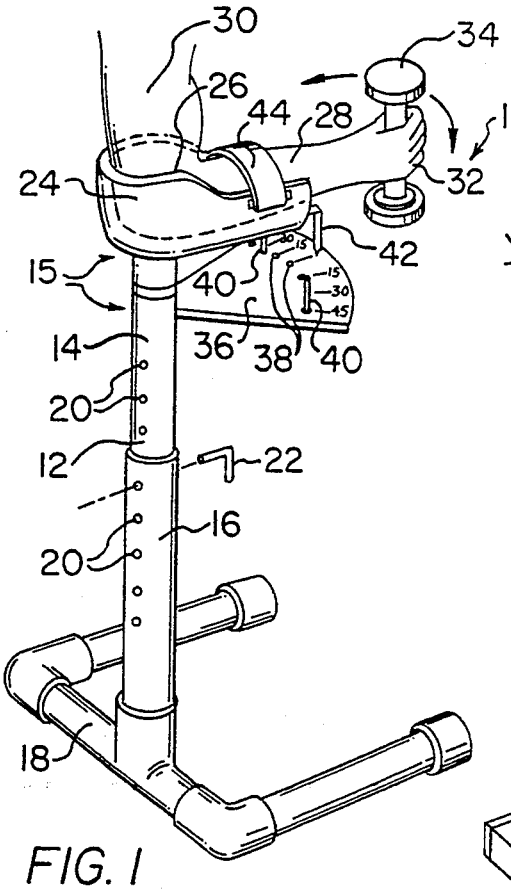
FIG. 1 is a perspective view of one embodiment of the subject exercise device for isolating the rotator cuff musculature wherein the device includes a vertical stand having a rotatably mounted anatomically shaped elbow receiving cup mounted thereon for securing the forearm of a user at a 90° to the upper arm.

In FIG. 1, one embodiment of the subject exercise device for isolating the rotator cuff musculature is shown having general reference numeral 10. The exercise device 10 includes a vertical stand 12 having an upper tube member 14 slidably received inside a lower tube member 16. The lower tube member 16 is mounted on a ground engaging base 18. The height of the stand 12 is adjusted by indexing holes 20 disposed along the length of the tube, or can have the elbow cup slide along the tube at any height desired, members 14 and 16 and securing the upper tube member 14 on the lower tube member 16 by inserting a pin 22 through the selected holes 20. An elbow receiving cup 24 is pivotally mounted on a top portion 15 of the upper tube member 14.

The height of the stand 12 with elbow cup 24 is adjusted for placement of a user's elbow 26 therein and holding a lower arm 28 of the user at a 90° angle to an upper arm 30. The elbow cup 24 adapted for pivoting inwardly toward the body of the user during internal rotation of the lower arm 28 and adapted for pivoting outwardly away from the body of the user during external rotation of the lower arm 28. A hand 32 of the user is shown gripping an exercise weight such as a barbell 34 for adding weight and resistance to the user's arm during the exercise and rehabilitation of rotator cuff musculature. The body of the user of the exercise device as described herein is not shown in the drawings.

Figure 2:
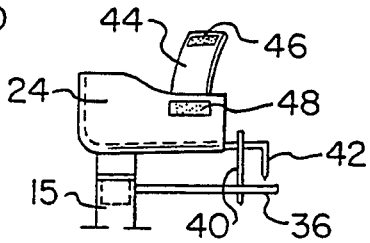
FIG. 2 illustrates a side view of the elbow receiving cup with a releasable strap for securing the forearm inside the elbow receiving cup at a 90° angle.

Attached to the top portion 15 of the upper tube 14 is an outwardly extending arm rotation indicator scale 36 having degrees of movement marked thereon. For example, the indicator scale 36 may show from 0° to 90° for external rotation of the arm and from 0° to 90° for internal rotation of the arm. Placed adjacent the degree markings are apertures 38 for receiving a removable pointed or pin stop 40. The stop 40 is shown in FIG. 2 and is used to control the amount of movement of the arm during internal and external shoulder rotation, and does not allow an individual to go past a certain range. The stop 40 engages an outwardly extending degree indicator pin or prong 42 which is attached to the front of the elbow cup 24. The pin or prong 42 is used to read the angular movement in degrees on the indicator scale 36. In FIG. 1, the pin 42 is at a 0° reading on the indicator scale 36. The separate and independent range limiters and indicators of the present invention provide features which are important in dealing with the sensitive shoulder joint in a therapy or injury prevention program.

In FIG. 2 a side view of the elbow cup 24 is shown which is anatomically shaped for holding the elbow 24 therein and the lower arm 28 at a right angle to the upper arm 30. The elbow cup 24 also includes a releasable strap 44 having hook and loop fasteners 45 and 46 for securing the lower arm and preventing excess or compensatory movement 28 securing inside a portion of the elbow cup 24. On the bottom of the elbow cup 24 is a downwardly extending pin or prong 42 used for rotatably receipt inside the top portion 15 of the upper tube member 14. In this example of the subject invention, the elbow cup 24 freely rotates on top of the stand 12 with no resistance built into the device other than a weight held in the hand 32 during internal and external rotation of the lower arm and the humerus bone 28.

In the use of exercise device 10, a user will set and secure elbow receiving cup 24 at a height such that the elbow of the user can be placed into elbow receiving cup 24 with the fore arm at a 90° to the upper arm ready to perform the desired internal and external rotation exercises.

A user can monitor their range of movement of internal and external shoulder rotation by using the range of motion indicator scale 36 on either side of a prong 42 attached to the bottom of elbow receiving cup 24. Prong 42 moves with elbow receiving cup 24, and thus moves the respective range of motion indicators 36 on either side of prongs 42. Once both internal and external shoulder rotations have been completed, user can then see where the range of movement indicator scale 36 have stopped, and then read what degrees of internal and external movement they have accomplished. User can also limit their range of movement by setting stops 40 at various degrees on semi-circular indicator scale 36 that sits beneath prong 42. User sets stops at appropriate degrees on indicator scale 36, then when the user rotates their arm internally and externally with their arm held at a 90° angle in elbow receiving cup 24, the prong 42 that sits beneath elbow receiving cup 24, will stop once it reaches and engages a stop 40, thus stopping movement of elbow receiving cup 24 at a desired degree of angular rotation.

User can set and secure upper and lower arm at a 90° angle, by placing their elbow 26 and upper 30 and lower arm 28 in the tapered and padded elbow receiving cup 24. Once the user's arm is in place, the user can then further secure their lower arm 28 in a 90° position to the upper arm 30 by placing releasable strap 44 across receiving cup 24 and tightening strap 44. Maintaining lower arm 28 at a 90° angle to upper arm 30 is extremely important to ensure that all muscle force involved in internal and external rotation, thus assuring the isolation of the internal and external rotator cuff muscles.

Exercise device 10 is designed to help enhance rotator cuff isolation and development when external resistance is used to strengthen those muscles. External resistance can be provided by free weights, cable pulley systems, springs, and elastic or rubber tubing. The elbow receiving cup 24 of device 10 is used to secure the user's lower arm 28 at a 90° angle to the upper arm 30 in order to ensure proper biomechanics of movement of the rotator cuff muscles, thereby enhancing rotator cuff muscle development or rehabilitation. A further use of device 10 is to provide a user with a means in which to measure both internal and external shoulder rotation during and after the use of device 10. A further use of device 10 is to provide a user with a means in which to limit the range of internal and external shoulder rotation movement when performing internal and external shoulder rotation at any selected plane of movement from about 0° up to about 90°, and at any height selected on a moveable, but stable stand.

Figure 3:
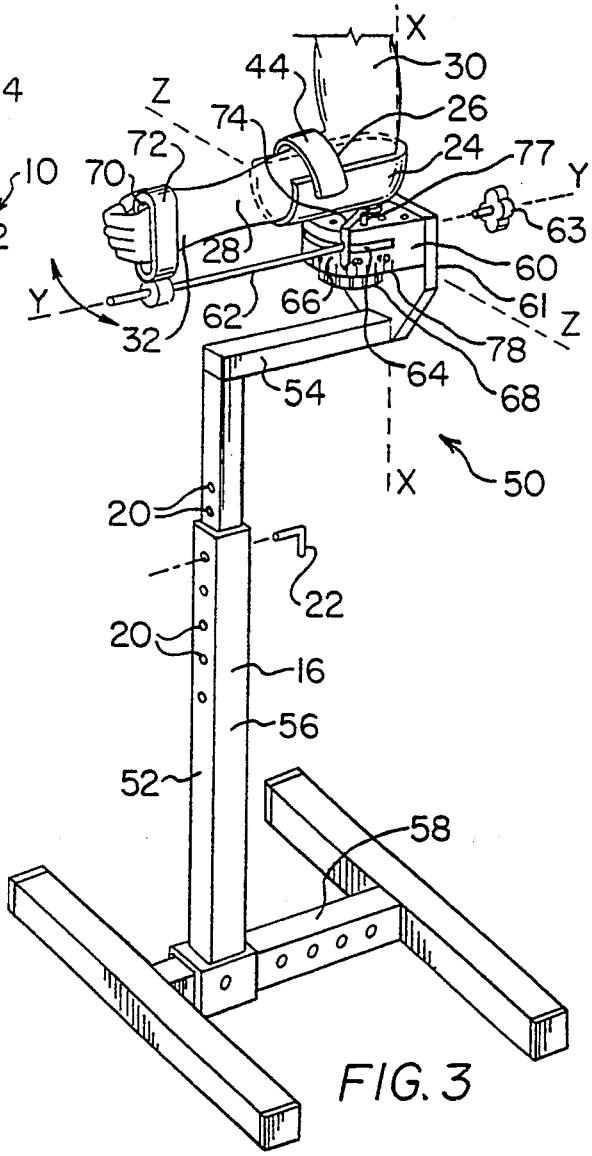
FIG. 3 is a perspective view of another embodiment of the subject exercise device wherein the device includes a vertical stand with the elbow receiving cup rotatably mounted on top of a clutch assembly with a pivot arm extending outwardly therefrom.
Figure 4:
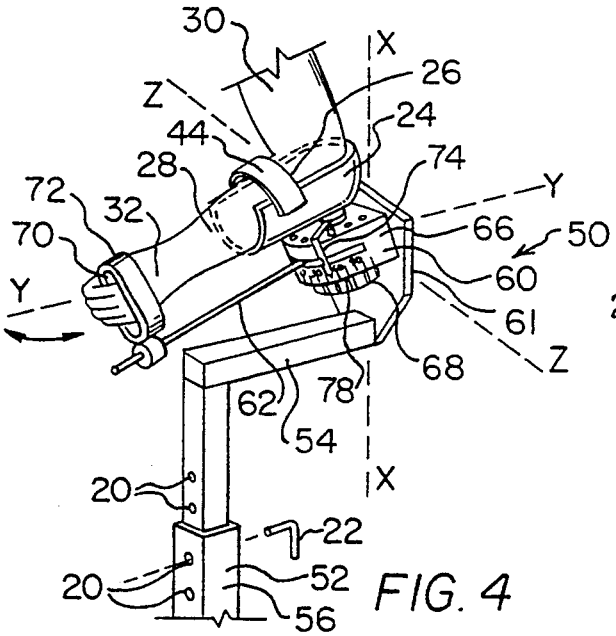
FIG. 4 is a perspective view of the exercise device as shown in FIG. 3 shows the hand rest wherein the clutch assembly with elbow receiving cup has been pivoted downward on the stand for moving the forearm at an angle from the horizontal.

FIG. 3 is a perspective view of another embodiment of the subject exercise device having a general reference numeral 50. The exercise device 50 includes a vertical stand 52 with an inverted "L" shaped upper tube member 54 adjustably mounted on a lower tube member 56 using indexing holes 20 and pin 22. The lower tube member 56 is mounted on an "H" shaped ground engaging base 58. In this illustration of the subject invention, the elbow receiving cup 24 is rotatably mounted on top of an adjustable resistance clutch assembly 60 and having a pivot arm 62 extending outwardly therefrom. The clutch assembly 60 is attached to a clutch assembly mounting plate 61 using a threaded hand screw 63. By loosening the hand screw 63, the clutch assemble 60 can be rotated on the mounting plate 61 as shown in FIG. 4. The mounting plate 61 is attached to an end of the upper tube member 54.

The pivot arm 62 swings in an arcuate pivot opening 64 in a curved side of a clutch housing 66. In FIG. 3, the pivot arm 62 with lower arm 28 move, when making both internal and external rotation using the exercise device 10, in a horizontal plane made up of the "Y" and "Z" axis as shown in the drawings. The opening 64 may have an arc of 180° or more, for allowing a full range of motion of the lower arm 28. Mounted on the bottom of the clutch housing 66 is a hand nut 68 which is used to tighten and loosen the movement of clutch assembly 60, and to thereby tighten and loosen the resistance of pivot arm 62 in both clockwise and counterclockwise directions.

In FIG. 3, the elbow 26 can be seen resting in elbow and strapped in by the strapping cup 24 with the hand 32 received inside an opening 70 in a hand rest 72. The hand rest 72 is adjustable along the length of the pivot arm 62. The hand 32 may be used to grip one side of the hand rest 72 during an exercise period or the hand 32 can merely rest inside the hand rest Referring now to both FIGS. 3 and 5, the clutch assembly 60 is shown with a pair of range of motion markers 74 slidably mounted on top of the clutch housing 66. The markers 74 are secured to a threaded shaft 76, and extend over the top and down the side of housing 66. A scale 78 is located on the side of housing 66. The markers 74 indicate the degree of movement of the pivot arm 62 when the pivot arm 62 engages a portion of marker 74 and moves one of the markers 74 outwardly or inwardly. For example in FIG. 5, the pivot arm 62, which has been previously pivoted outwardly, is shown to have moved the marker 74 past the 60° mark on the scale 78. Using markers 74 and scale 78, the range of motion of the rotator cuff muscles and rotation of the shoulders of a user can be monitored and progress noted during exercise training and rehabilitation. While scale 78 is shown from 0° to 90°, the scale 78 can easily be increased to 120°, or greater, depending on the degree of movement of the pivot arm 62 on the clutch assembly 60.

Figure 5:
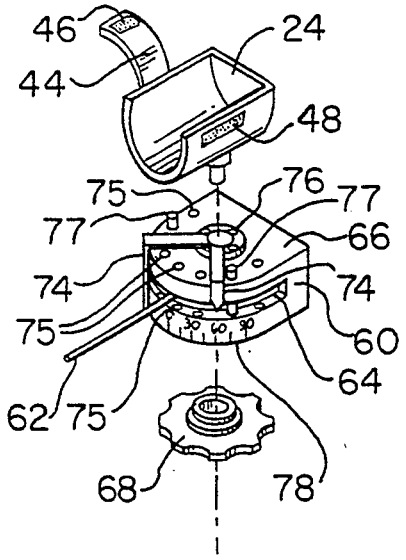
FIG. 5 illustrates an enlarged, exploded perspective view of the elbow cup and the clutch assembly with a resistance adjusting hand nut, and showing a portion of the pivot arm extending outwardly therefrom.

For example in FIG. 5, the pivot arm 62, which has been previously pivoted outwardly, is shown to have moved the marker 74 past the 30° mark on the scale 78. Using markers 74 and scale 78, the range of motion of the rotator cuff muscles and rotation of the shoulders of a user can be monitored and progress noted during exercise training and rehabilitation. While scale 78 is shown from 0° to 90°, the scale 78 can easily be increased to 120°, or greater, depending on the degree of movement of the pivot arm 62 on the clutch assembly 60. Additionally, due to the manner in which elbow cup 24 secures and directs the forearm of a user at a 90° angle to the upper arm, and the way that strap 44, in conjunction with elbow cup 24 prevent forearm involvement, plus the use of hand-rest 70, which eliminates the need to use the muscles of the wrist, hand, forearm during movement, accurate measurement of internal and external shoulder rotation can be gauged.

Also shown in FIGS. 3 and 5 is the clutch assembly 60 with a plurality of pin holes 75 disposed in a space relationship on top of the clutch housing 66 for receiving a pair of range of motion limit pins 77 for engaging a side of the range of motion markers 74 and limiting the travel of the pivot arm 62 during internal and external rotations of the lower arm 2e. In FIG. 5, the pins 77 have been placed in pin holes 75 to prevent internal and external rotation past the 60° mark on scale 78. The pin holes 75 can be spaced at various degrees on the scale 78 depending on the desired movement required during rehabilitation of the rotator cuff musculature.

Figure 4A:
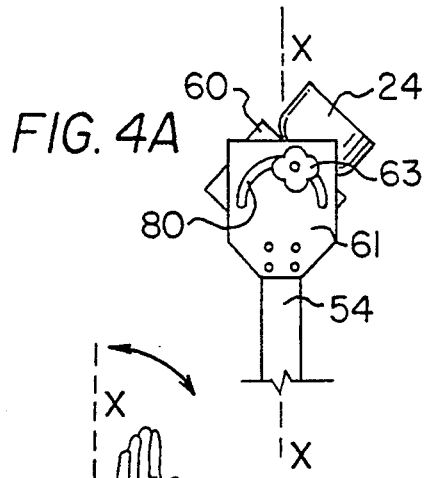
FIG. 4A illustrate the backside of a clutch assembly mounting plate with the clutch assembly and elbow cup rotated thereon as shown in FIG. 4.

Referring now to both FIGS. 4 and 4A, the clutch assembly 60 is shown rotated on the mounting plate 61 in a clockwise fashion in a range of 30° or greater from the horizontal. The lower arm 28 and pivot arm 62 are now free to operate in a plane at an angle to the horizontal plane made up of the "Y" and "Z⇄ axis. In FIG. 4A, the back side of the mounting plate 61 is shown having a semi-circular slot 80 cut therethrough. By loosing the threaded hand screw 63, the clutch assembly 60 with elbow receiving cup 24 can be rotated up to about 90° either to the left or right of the vertical axis "X". This important feature allows the user of the exercise device 10 to do not only the internal and external rotations in a horizontal plane but to exercise the rotator cuff musculature at angles up to about 90° from the horizontal plane defined by the "Y" and "Z" axis.

Exercise device 50 is mounted atop a vertical stand 52 in which its height is adjustable to accommodate the height of the user while standing, seated or lying on a bench. The adjustable clutch assembly 60 and elbow cup 24 can be pivoted through a range of about 180° and secured in place, to allow for adjustment of about 0° through about a 90° plane of movement to either side, right or left, to accommodate internal and external shoulder rotation in any desired or needed plane of movement. The diverse range of adjustment in height and the ability to select from any desired plane of movement, allows the user to adjust device 50 to the direct needs of their specific sport or therapy program.

In addition, range of motion stops 40 and range of motion indicators 36 are carried on clutch assembly 60, which allows a user to monitor and to test the exercise or the rehabilitation therapy of internal and external shoulder rotation and the rotator cuff muscles.

The use of the anatomically shaped and padded elbow receiving cup 24, along with the releasable securing and tightening strap 44 located on elbow cup 24, the upper arm 30 and lower arm 28 are fixed and locked at a 90° angle to one another. This fixed 90° angle limits all arm motion to be limited to rotating muscle action which is related to turning or rotating force, thereby better isolating the rotator cuff muscles. Also by using the releasable strap 44, the elbow joint is locked and secured, so that no excess or compensatory movement can occur, thus enhancing the rotator cuff isolation.

Furthermore, the user can use a hand grip 98 at the end of the pivot arm 62 extending from clutch assembly 60, for rotating the pivot arm 62 against resistance, or they can use a padded hand-rest 72. The hand-rest 72 allows the user to place their relaxed hand or prosthesis in the hand-rest hole 70, so that there will be no hand or forearm muscle or wrist joint involvement or action. This eliminates any unnecessary or compensatory involvement of other muscle groups or joints in the arm or elbow, other than the shoulder joint and the rotator cuff muscles.

The user can select from various settings of resistances, for both internal and external shoulder rotation. Resistance clutch assembly provides smooth, constant resistance throughout the entire range of movement, and is safe, with no backlash or jerking pull from the machine.

Figure 6:
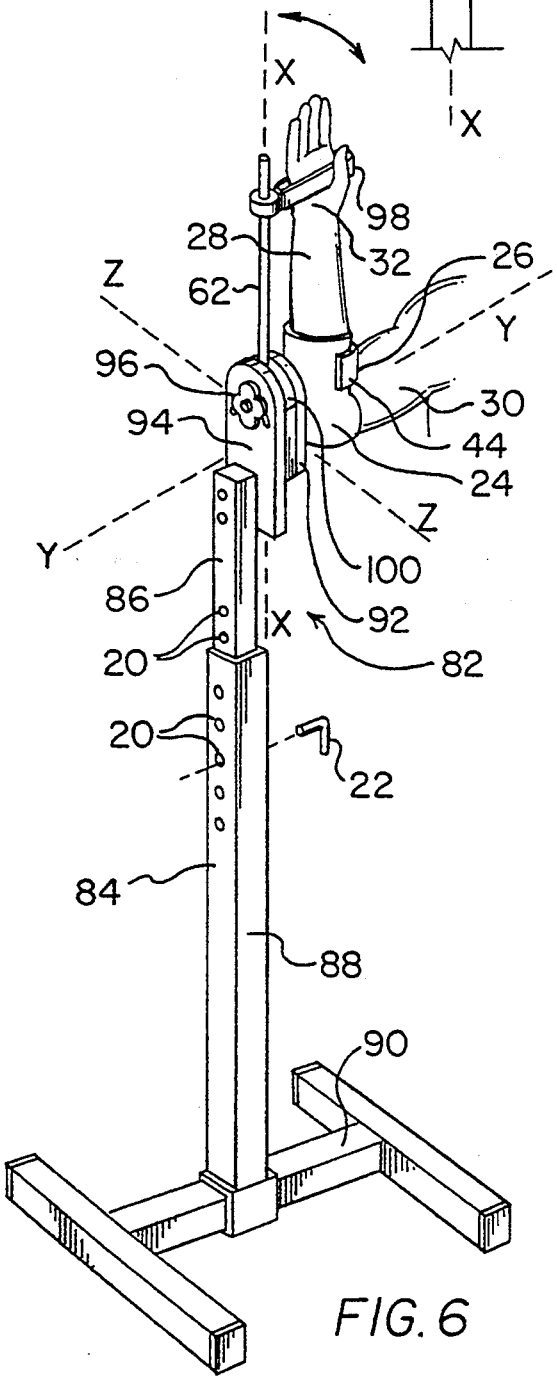
FIG. 6 is a perspective view of still another embodiment of the subject exercise device wherein the device includes a vertical stand with the elbow receiving cup rotatably mounted on the side of a clutch assembly with a pivot arm extending upwardly therefrom.

FIG. 6 illustrate another embodiment of the subject invention wherein the exercise device has a general reference numeral 82. The exercise device 82 is mounted on a vertical stand 84 having an upper tube member 86 slidable received in a lower tube member 88 and having holes 20 and pin 22 for adjusting the height of stand 84. The stand 84 is mounted on a ground engaging "H" shaped base 90. In this example, the elbow cup 24 is rotatably mounted on an adjustable resistance clutch assembly 92 which is similar to the clutch assembly 60 shown in FIGS. 3–5. The clutch assembly 92 is rotatably mounted on a clutch assembly mounting plate 94 using a threaded hand screw 96.

In FIG. 6 it is important to note that the upper tube member 86 is adjusted on the stand 84 so that the elbow 26 is received in the elbow cup 24 with the upper arm 30 extending outwardly and approximately horizontal from the body of the user. The elbow cup 24 with the elbow 26 secured therein and the lower arm 28 operate with internal and external rotations in a vertical plane make of the "X" and "Z" axis. The lower arm 28 is shown disposed adjacent the pivot arm 62 with the hand 32 gripping a handle 98. The handle 98 is adjustable along the length of the pivot arm 62 for various lengths of lower arms 28. The clutch assembly 92 includes a pivot opening 100 therein which allows for the pivoting of the pivot arm 62 on the clutch assembly 92. By design, the pivot opening 100 allows the pivot arm 62, as shown in FIG. 6 in a vertical position, to pivot up to 90° or less from the vertical axis "X" during forward or internal rotations or 90° backward or external rotations. The limitation of moving the lower arm 28 forward and up to but not greater than 45° from the vertical during internal rotations of the rotator cuff musculature is important during rehabilitation or strengthening the rotator cuff muscles, because it helps prevent the harmful shoulder impingement that occurs during internal shoulder rotation while the arm is abducted at 90°.

Figure 6A:
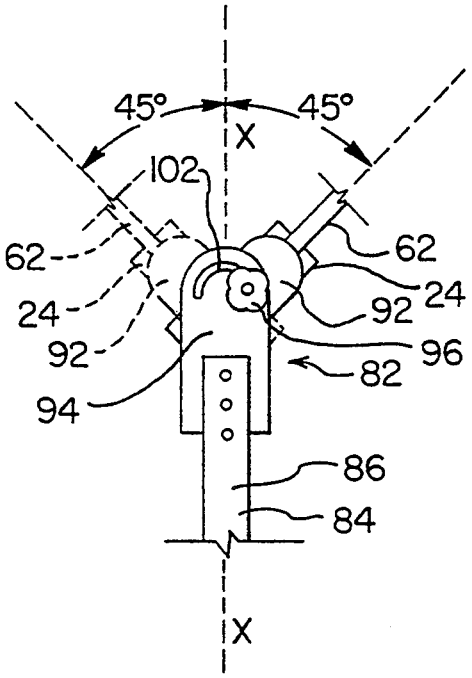
FIG. 6A illustrate the backside of a clutch assembly mounting plate with the clutch assembly and elbow cup rotated thereon as shown in FIG. 6.

In FIG. 6A, the backside of the clutch assembly mounting plate 94 is shown having a semi-circular slot 102 cut therethrough for receiving a portion of the threaded hand screw 96. By loosing the hand screw 96, the clutch assembly 92 with elbow cup 24 can be rotated counterclockwise up to about 45° or greater, as shown or the clutch assembly 92 can be rotated clockwise up to about 45°, or greater, as shown if dotted lines. By rotating the clutch assembly 92 on the mounting plated 94, the amount of external rotation of the pivot arm 62 from the vertical axis "X" can be increased and the amount of internal rotating decreased.

Exercise device 82 is mounted adjacent to a vertical stand 84 in which its height is adjustable along the stand, to accommodate the height of the user while standing, and performing internal and external shoulder rotation with the upper arm 30 abducted at 90° to the lower arm 28. The clutch assembly 92 and elbow cup 24 can be pivoted through a range of about 90°, or greater, and secured in place, to allow for adjustment of 0° through about 45°, or greater, to either side, right or left. This adjustment is a safety feature that allows the user to adjust and limit the range of internal shoulder rotation that can be accomplished, while increasing the range of external shoulder rotation that can be reached. This safety feature is very important, and is not seen on any other rotator cuff exercise/therapy device. By limiting internal shoulder rotations, when the upper arm 30 is abducted at 90° to the lower arm 28, there is limited shoulder impingement. Harmful shoulder impingement occurs if the shoulder is internally rotated in excess ranges, while the upper arm is at a 90° abduction. Shoulder impingement syndrome can be extremely damaging to an athlete's or patient's shoulder joint. Yet by increasing the range capability for external shoulder rotation, the user can then increase the strength in the weaker external rotators, while stretching and increasing the flexibility in the tighter and stronger internal rotators.

In addition, range limiters 40 and range indicators 36 are on the clutch assembly 92, which allows for monitoring, testing, and rehabilitation/therapy, of internal and external shoulder rotation and the rotator cuff muscles.

The use of the anatomically shaped and padded elbow cup 24, along with the securing and tightening strapping 44 on the elbow cup 24, the upper arm 30 and lower arm 28 are fixed and locked at a 90° angle. This fixed 90° angle isolates all muscle action to be related to turning or rotating force, thus the rotator cuff muscles are better isolated. Also by using the strapping 44 and the elbow cup 44, the lower arm 28 and elbow joint are locked in and secured, so that no excess of compensatory movement can occur, thus enhancing the rotator cuff isolation.

The user can adjust clutch 92 for various resistance settings for both internal and external shoulder rotation. The resistance of clutch 92 is smooth, constant throughout the entire range of movement, and is safe with no backlash or jerking pull from the machine.

Figure 7:
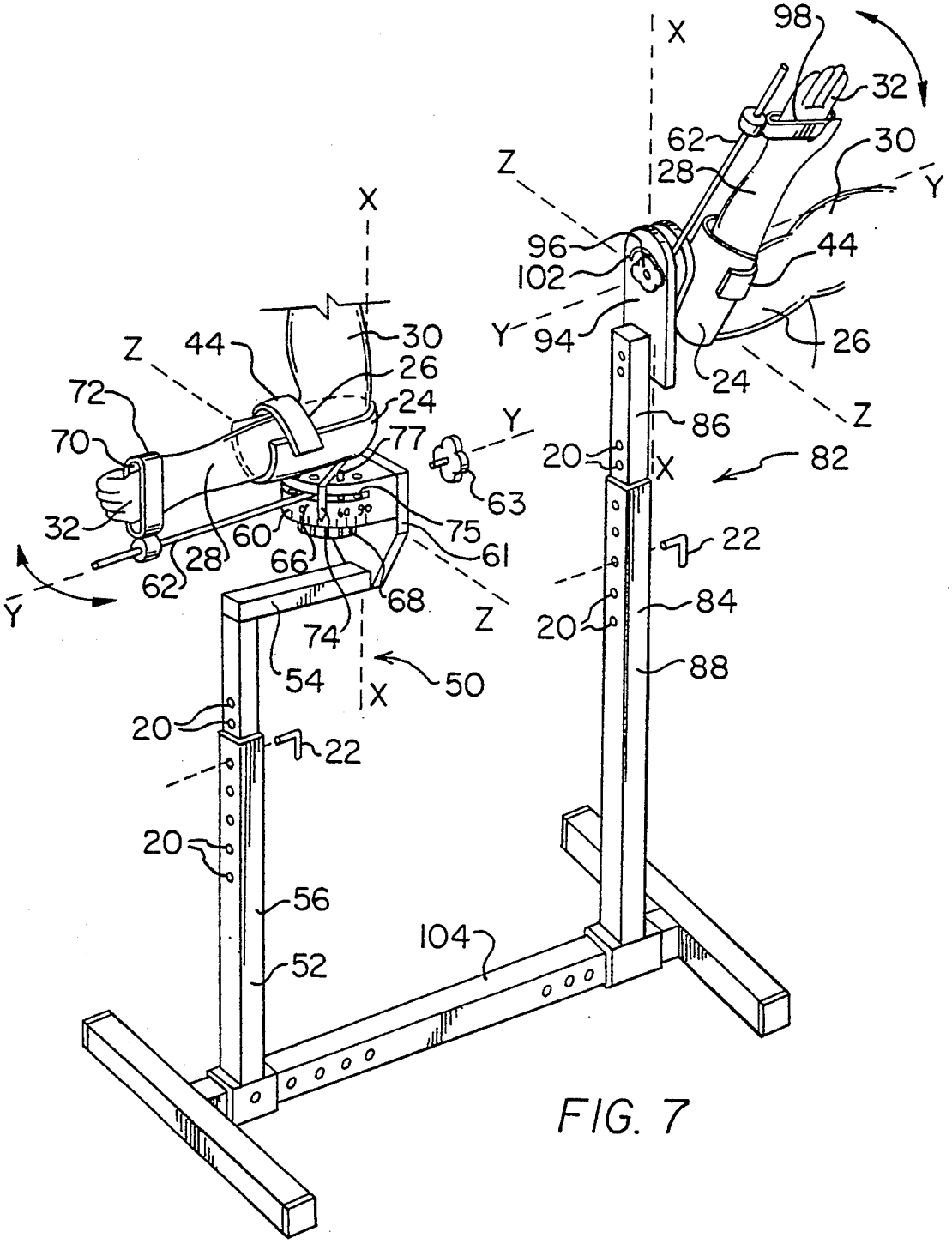
FIG. 7 is a perspective view of another embodiment of the subject invention incorporating the exercise device shown in FIG. 3 with the exercise device as shown in FIG. 6 and mounted on a single base.

FIG. 7 incorporates the novel features of the exercise device 50 as shown in FIGS. 3 and 4 together with the unique features of the exercise device 82 shown in FIG. 6. In this example the two devices 50 and 82 have a common "H" shaped ground engaging base 104. By adjusting the exercise devices 50 and 82 at opposite sides of the base 104, one user can exercise the rotator cuff musculature with his or her elbow 26 secured in an elbow cup 24 with internal and external shoulder rotations performed in a horizontal or 0° to 45° plane while another user at the same time has his or her elbow 26 secured in a second elbow cup 24 with internal and external rotations performed in a vertical plane.

This unit combines a horizontal stand exercise device 50 and a vertical stand exercise device 82 together to provide a variety of uses and needs for two people at the same time, while being mounted to a compact and stable, single base frame 104. This makes the unit more cost efficient, provides more diversity of uses, takes up little space yet allows for two people to work on the system at the same time. There are currently no other known rotator cuff exercise devices which such a variety of uses, as well as having the capability to have two people working their rotator cuff muscles at the same time.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An exercise device which is useful for the development of rotator cuff musculature of a user by isolating the head of the humerous in the glenoid cavity during internal and external rotation, including in combination:

an upright vertical stand which includes at least one portion which is to be located adjacent to the elbow of a user;

an elbow receiving and securing means which is rotatably mounted on said upright vertical stand at one said portion which is to be located adjacent to the elbow of a user, said elbow receiving and securing means being in the form of an L-shaped receptacle which is anatomically contoured to receive the elbow of a user in a snug fit, and which further includes an open substantially concave extension which is adapted to be parallel to the axis of the forearm of a user and to receive at least a portion of the forearm of a user, and an open substantially concave extension which is adapted to be parallel to the axis of the upper arm of a user and receive at least a portion of the upper arm of a user at the elbow and hold the lower arm of a user at about a 90° angle to the upper arm of that user, and, during internal and external shoulder rotation, guides the lower arm of a user at about a 90° angle to the upper arm of that user; whereby, when a user positions an elbow in said means for receiving and securing the elbow, with the lower arm positioned at about 90° from the upper arm of the user, and then rotates that arm, the head of the humerus is substantially isolated in the glenoid cavity during both internal and external rotation, so that the inner rotator cuff muscles and the outer rotator cuff muscles of the user are exercised.

2. The exercise device of claim 1 in which said rotatably mounted elbow receiving and securing means is mounted on the top of said stand for rotation in the horizontal plane.

3. The exercise device of claim 1 in which said rotatably mounted elbow receiving and securing means is mounted on the top of said stand for rotation in the vertical plane.

4. The exercise device of claim 1 in which there is associated with said upright vertical stand, means for adjusting the height of said upright vertical stand so that said rotatably mounted elbow receiving and securing means may be used by a standing user of any height, or while a user is seated or in a supine position.

5. The exercise device of claim 1 in which said elbow receiving and securing means is tapered and padded.

6. The exercise device of claim 1 in which said elbow receiving and securing means has an open semi-cylindrical extension which is adapted to be parallel to the axis of the forearm of a user, and to receive at least a portion of the lower arm of a user.

7. The exercise device of claim 1 in which a lower arm securing mechanism is associated with said elbow receiving and securing means for use in securing the elbow and lower arm of a user within said elbow receiving means.

8. The exercise device of claim 7 in which a lower arm securing mechanism is associated with said the open semi-cylindrical horizontal extension of said elbow receiving and securing means for use in securing the elbow and lower arm of a user within the elbow receiving means.

9. The exercise device of claim 7 in which said lower arm securing mechanism is a strap.

10. The exercise device of claim 9 in which said strap is adjustable, and provides means for pulling the two sides of the elbow receiving receptacle together, thereby securing the forearm of a user in place, and eliminating excess or compensatory movement patterns and assuring that upper arm and lower arm of the user are locked and secured at a 90° angle throughout their rotation, in order to ensure proper isolation of the rotator cuff muscles.

11. The exercise device of claim 1 in which different size elbow receiving and securing means are provided in order to accommodate users having different size elbows.

12. The exercise device of claim 1 in which there is associated with said rotatably mounted elbow receiving and securing means, a means for measuring the rotation of a users arm, as an indication of the range of motion of the shoulder rotation of a user.

13. The exercise device of claim 1 in which there is associated with said rotatably mounted elbow receiving and securing means, a physical stop means for limiting the range of motion of the shoulder rotation of a user.

14. The exercise device of claim 1 in which there is an external source of resistance held by a user.

15. The exercise device of claim 1 in which there is a means for providing resistance carried by said exercise device and associated with said rotatably mounted elbow receiving and securing means, which resistance means provides resistance to clockwise and to counterclockwise rotation of said elbow receiving and securing means.

16. The exercise device of claim 15 in which said means for providing resistance carried by said exercise device and associated with said rotatably mounted elbow receiving and securing means is a resistance clutch.

17. The exercise device of claim 16 in which the resistance of said resistance clutch is adjustable.

18. The exercise device of claim 17 in which a pivot arm having a first end and a second end is connected at its said first end to said adjustable clutch, said clutch being adapted to extend horizontally, vertically or at an angle from the vertical outward from said clutch.

19. The exercise device of claim 18 in which said clutch is oriented so that the associated pivot arm rotates vertically, and safety adjustment stop means are provided for adjusting and limiting the range of internal rotation of said pivot arm, and thereby the range of internal rotation of the shoulder a user, and thereby avoiding the occurrence of harmful shoulder impingement.

20. The exercise device of claim 1 in which said clutch and said associated elbow receiving and securing means is held by means for adjustably setting the plane at which the forearm securing portion of said elbow receiving and securing means is held during internal and external shoulder rotation.

21. The exercise device of claim 1 in which said upright vertical stand is at a height such that it may be used by a standing user, a resistance clutch is connected to said elbow receiving and securing means, and a pivot arm having a first end and a second end is connected at its said first end to said clutch with said pivot arm extended vertically so that a user may use it in a standing position, with the upper arm in 90° shoulder abduction from the side of the body.

22. The exercise device of claim 21 in which physical stops are used to limit the range of internal rotation of said elbow receiving and securing means and said pivot arm at 90° shoulder abduction, thereby avoiding the occurrence of potentially harmful shoulder impingement.

23. The exercise device of claim 18 in which said pivot arm means are at least the length of the lower arm of a user, and gripping means or hand or arm receiving means are located substantially adjacent to said second end of said pivot arm means.

24. The exercise device of claim 23 in which said hand grips or hand or arm receiving means are adjustable along the length of said pivot arm means in order to accommodate users having different lengths of lower arms.

25. The exercise device of claim 23 in which hand or arm receiving means are utilized, said hand or arm receiving means adapted to be secured by an open or a relaxed hand and fingers, or by a forearm, or by a prosthetic hand or forearm of an amputee, rather than by gripping, thereby eliminating the active involvement of the fingers, forearm and hand muscles, thereby increasing the isolation of the rotator cuff muscles, and avoiding the problems which are caused by the use of a hand grip.

26. The exercise device of claim 1 in which two exercise devices for the development of rotator cuff musculature are carried by a common base which allows two users to work their rotator cuff muscles at the same time, on the same device.

* * * * *